US006119754A

United States Patent [19]

Okonsky

[11] Patent Number: 6,119,754

[45] **Date of Patent: *Sep. 19, 2000**

[54] RETRACTABLE PET/BABY GATE ASSEMBLY WITH ALARM

[76] Inventor: Teresa M. Okonsky, P.O. Box 15241, Arlington, Va. 22215

[ * ] Notice: Under 35 U.S.C. 154(b), the term of this patent shall be extended for 579 days.

[21] Appl. No.: 08/828,375

[22] Filed: Mar. 28, 1997

Related U.S. Application Data

[63] Continuation of application No. 08/391,546, Feb. 21, 1995, abandoned.

[51] Int. Cl.[7] ..... G08B 13/08

[52] U.S. Cl. ..... 160/10; 160/26; 160/33; 160/160

[58] Field of Search ..... 160/10, 26, 23.1, 160/24, 29, 33, 136, 152, 160

[56] References Cited

U.S. PATENT DOCUMENTS

| | | | |
|---|---|---|---|
| 341,313 | 5/1886 | Brocklebank | 160/33 |
| 526,211 | 9/1894 | Young | 160/33 |
| 647,419 | 4/1900 | Levy | 160/33 |
| 951,643 | 3/1910 | Rettig et al. | 160/33 |
| 1,012,849 | 12/1911 | Hedwall | 160/33 |
| 1,150,684 | 8/1915 | Klotz | 160/33 |
| 1,216,794 | 2/1917 | Garman | 160/23.1 |
| 1,822,729 | 9/1931 | Fairhurst | 160/33 |
| 1,882,331 | 10/1932 | Martinek | 160/33 |
| 2,015,993 | 10/1935 | Drake | 160/23.1 |
| 2,503,773 | 4/1950 | Schuster et al. | 160/23.1 |
| 3,842,890 | 10/1974 | Kramer | 160/26 |
| 4,160,972 | 7/1979 | La Mell et al. | 160/10 |
| 4,758,824 | 7/1988 | Young | 160/10 |
| 4,821,786 | 4/1989 | Johnston | 160/23.1 |
| 4,825,921 | 5/1989 | Rigter | 160/23.1 |
| 5,274,357 | 12/1993 | Riordan | 160/10 |
| 5,275,220 | 1/1994 | Siegal | 160/24 |

*Primary Examiner*—David M. Purol

[57] ABSTRACT

A retractable gate assembly that can be mounted either on or recessed within a wall. The assembly preferably having an alarm system to notify others that the gate is being touched. The gate assembly is most commonly used as a baby-gate at the top and bottom of stairwells or at kitchen entrances to avoid injury. The gate assembly is also used as a pet-gate.

14 Claims, 9 Drawing Sheets

RETRACTABLE PET/BABY GATE ASSEMBLY WITH ALARM

This application is a continuation of application Ser. No. 08/391,546 filed on Feb. 21, 1995 now abandoned.

BACKGROUND OF THE INVENTION

One of the challenges of having infants/toddlers in a home is that they can wonder away very quickly from a supervising adult. It is a great concern when infants or toddlers have access to stairways or the kitchen area where items are possibly hot or chemically hazardous. In response to these concerns there has developed a commercial market for baby gates. The baby gate is positioned across the bottom and/or top of a stairwell to prevent the infant/toddler from reaching the first stairway tread. These same gates are also being used by pet owners to block thresholds into rooms and/or stairwells.

The baby gates on the market take different forms. One such example is a gate comprised of plastic mesh wherein the gate is held in place within a doorway or threshold by a pair of spring loaded rods. The spring loaded rods are tensioned to frictionally brace the gate within the threshold.

A second type of gate is also formed of a plastic mesh but the means of securing the gate differs from the first example. In this model the means to secure the gate takes the form of two wooden slats wherein the slats are formed with notches. A metal clip mechanism is used in combination with the notches so that the gate is interlockingly secured by a frictional fit within the threshold.

A third type of gate takes the form of an expandable assembly that, just as in the first two examples, is frictionally braced between two rigid elements such as opposite sides of a door threshold. This third type of gate has a quick release type of handle atop the assembly that is squeezed in combination with a safety button to retract elements which frictional engage the threshold.

The market also includes an accordion wooden gate with eyelets affixed to the ends. The first three examples of gates require that the gate be removed and stored in order to pass through the threshold. The accordion wooden gate, with some ingenuity, can be rigged to hang upon the wall in a retracted position when not in use. This takes quite an effort. As a result, these gates are also commonly expanded across the threshold and stored upon removal. What is also important to note is that if someone is ambitious enough to try and mount the accordion gate that the gate is spaced above the floor a substantial distance. As will be noted in this application, the gate would be spaced that substantial distance above the floor due to trim molding unless further wood is also mounted to the wall to make such coplanar with the molding. In any case, this act would take substantial amounts of time, would be unsightly and possibly dangerous depending on the hardware used.

SUMMARY OF THE INVENTION

A first feature of the invention is that it is a gate designed to be easily installed. A second feature of the invention is that it is safe and easy to operate. No lifting of the assembly or grasping is required. This is especially important for grandparents who may have difficulty in grasping and lifting yet also have grandchildren visiting their home. It is especially safe in that it does not rely on friction for securing the gate, both ends of the gate are screw-secured to the rigid elements that form the threshold. It is also very safe in that the bottom of the gate can be adjusted for minimal clearance with the floor. A further feature is that the gate is immediately accessible and does not require removal and storage at some other location. This means that passing through the threshold where the gate is expanded is very easy and does not require lifting. The invention is also pleasing to the eye and includes an alarm to alert an individual if the gate is being tampered with.

DETAILED DESCRIPTION OF THE INVENTION

Figure 1:
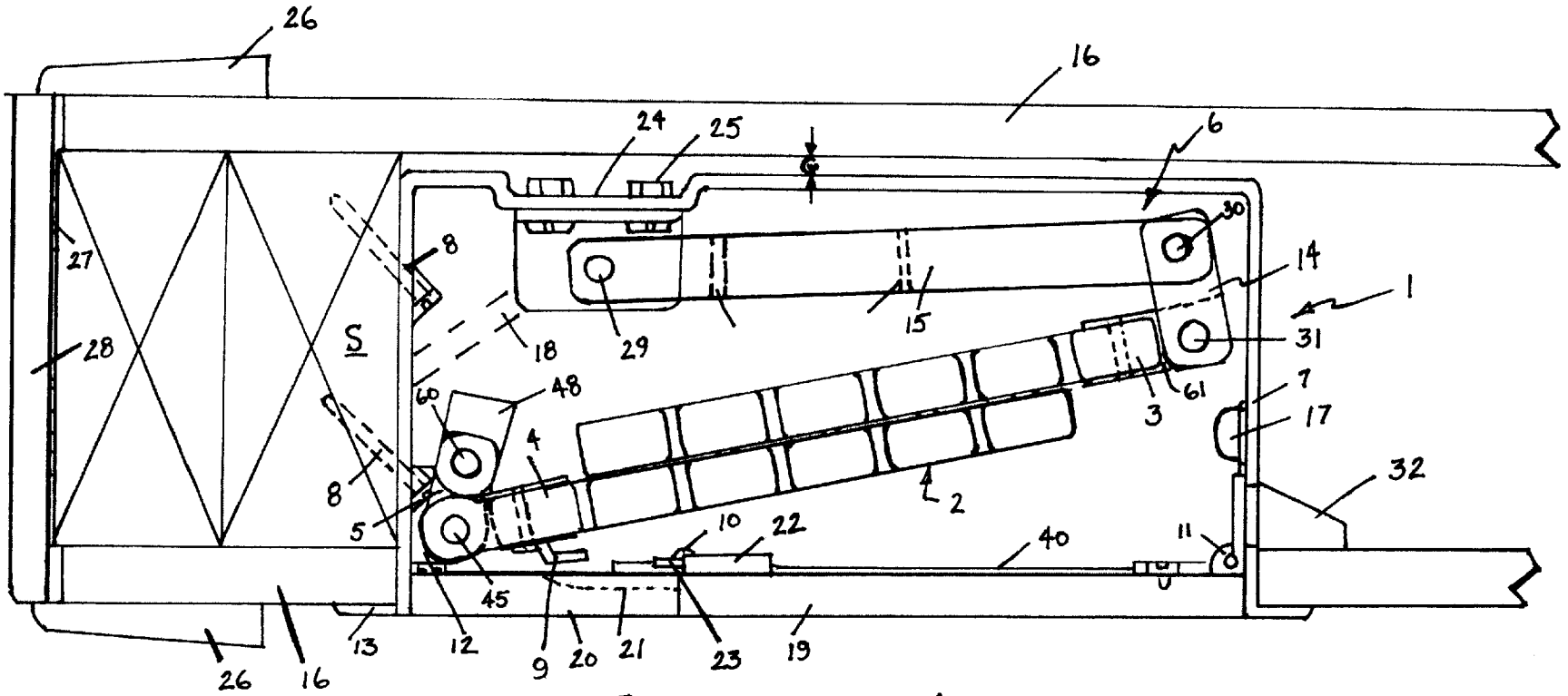
FIG. 1 is a sectional view of the invention using an accordion gate mounted within a finished wall.

FIG. 1 shows a recessed gate assembly 1. The gate assembly 1 is formed as a kit for installation into a finished wall. The installation of the kit requires the housing 7 to be secured to a rigid element such as a stud S within a wall of the home or commercial space. The housing is secured by screws or fasteners 8. In addition, the housing includes clips 32 which are inserted through rectangular slots in a side wall of the housing 7 as illustrated in FIG. 1. The clips snap into place in such a way as to fittingly press the finished wall, such as gypsum board, up against the trim 13 of the housing 7. The installer merely first locates the edge of a stud. This can be done by several methods and will be described in the instructions of the kit assembly. Once the location of the stud is determined, the installer will cut a hole in the drywall to the immediate left or right of the stud. FIG. 1 is an illustration wherein a stud was selected to the left of the housing 7. The housing 7 can readily be rotated vertically to mount the assembly onto a stud to the immediate right. Once the proper hole is cut, the housing is inserted into the opening and screw fastened to the stud. The clips 32 are then snapped into place so that the trim 13 is securely abutting the finished wall 16. Lastly, the installer will install screws or similar fasteners into the opposite rigid member, such as the door jamb 28 or newel post 34, onto which elements 48 will be slidably secured. The means of fastening the end of the gate 2 to the opposite rigid member can be performed in various ways without departing from the spirit and scope of the claims. One such example is to secure the elements 48 and rod 60 to the rigid element and provide a latching mechanism on the end 4 of the gate for attachment thereto.

FIG. 1 illustrates the invention with an accordion gate 2 folded within the housing 7. The accordion gate, as illustrated, is two rows wide and 7 rows long. The width of each accordion element is shown scaled to be 7/16 inch wide and has a length of ¾ inches. These dimensions are based on a working model but are only descriptive in nature. The final dimensions, of course, depend on the materials selected and the number of elements used. The illustrated accordion gate is less than six inches long when collapsed yet when expanded to three feet leaves less than 4 inches of gap between each element. The gate is expandable to much greater than three feet. FIG. 1 shows gaps between each accordion element. These gaps are not illustrative of the working model in that the accordion gate, when collapsed, is tighter fitting. However, over time there is the expectation of warping and bending which would lead to the illustrated spacing. Given this consideration, the housing is designed with the probable expansion in mind.

Figure 5:
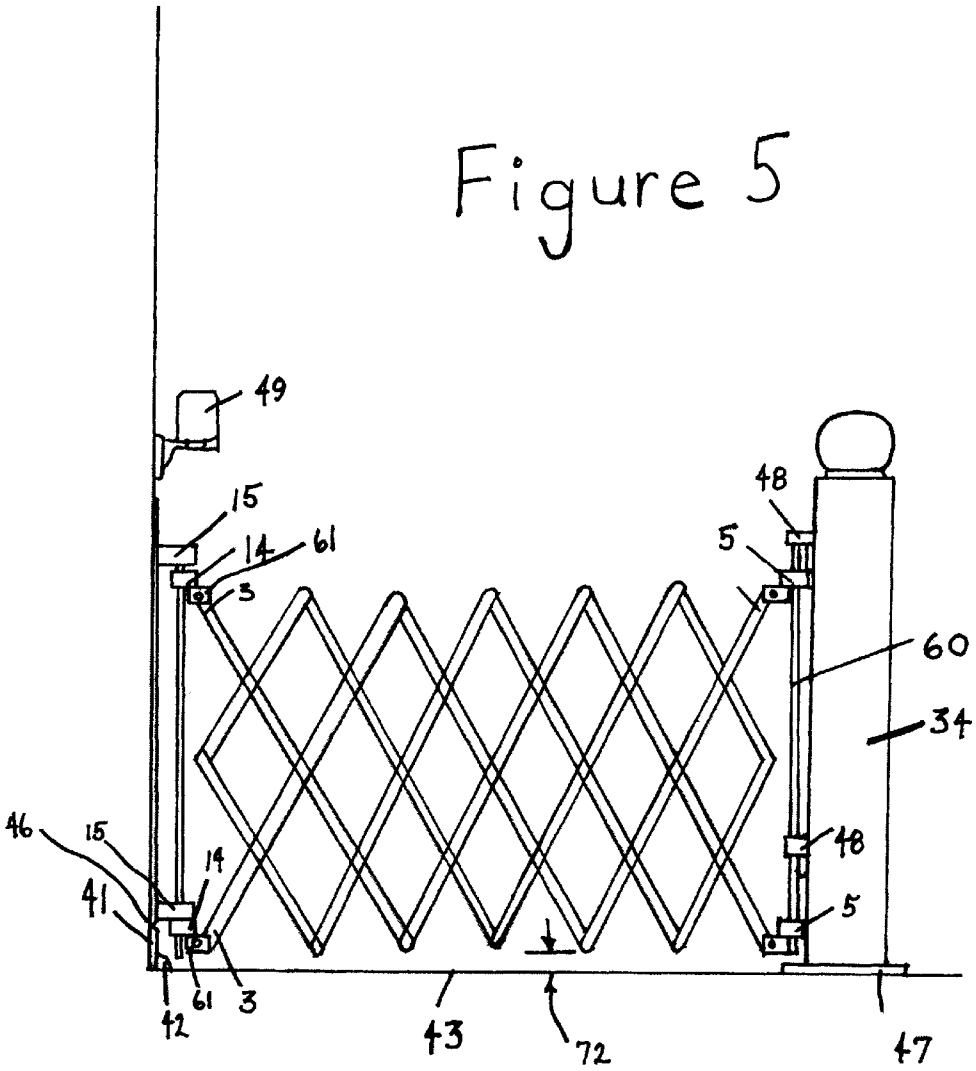
FIG. 5 is a side view of the gate assembly with the accordion gate.

Each end 3 of the accordion gate 2 is secured to elements 14 in a pivotal fashion for compactness. If the length of the housing was not a concern, elements 14 would not need to be pivotable with respect to elements 3. The elements 14 are further secured via a rod 30 in a pivotal fashion to elements 15. FIG. 1 shows the elements 15 as having reinforcing bracing 40 in phantom. FIG. 5 shows the expanded gate configuration. Elements 15 are pivotably secured to the housing via rod elements 29. Rod 29 need not be one continuous rod within the housing as shown by rod elements 58 in FIG. 10. Elements 15 are elongated so as to extend the gate assembly beyond the base and toe molding as illustrated in FIG. 5. Note that the gate assembly may extend below the bottom portion of the trim for the reasons described below. Once again, element 15 may comprise several elements or may be reinforced as is commonly known.

Figure 2:
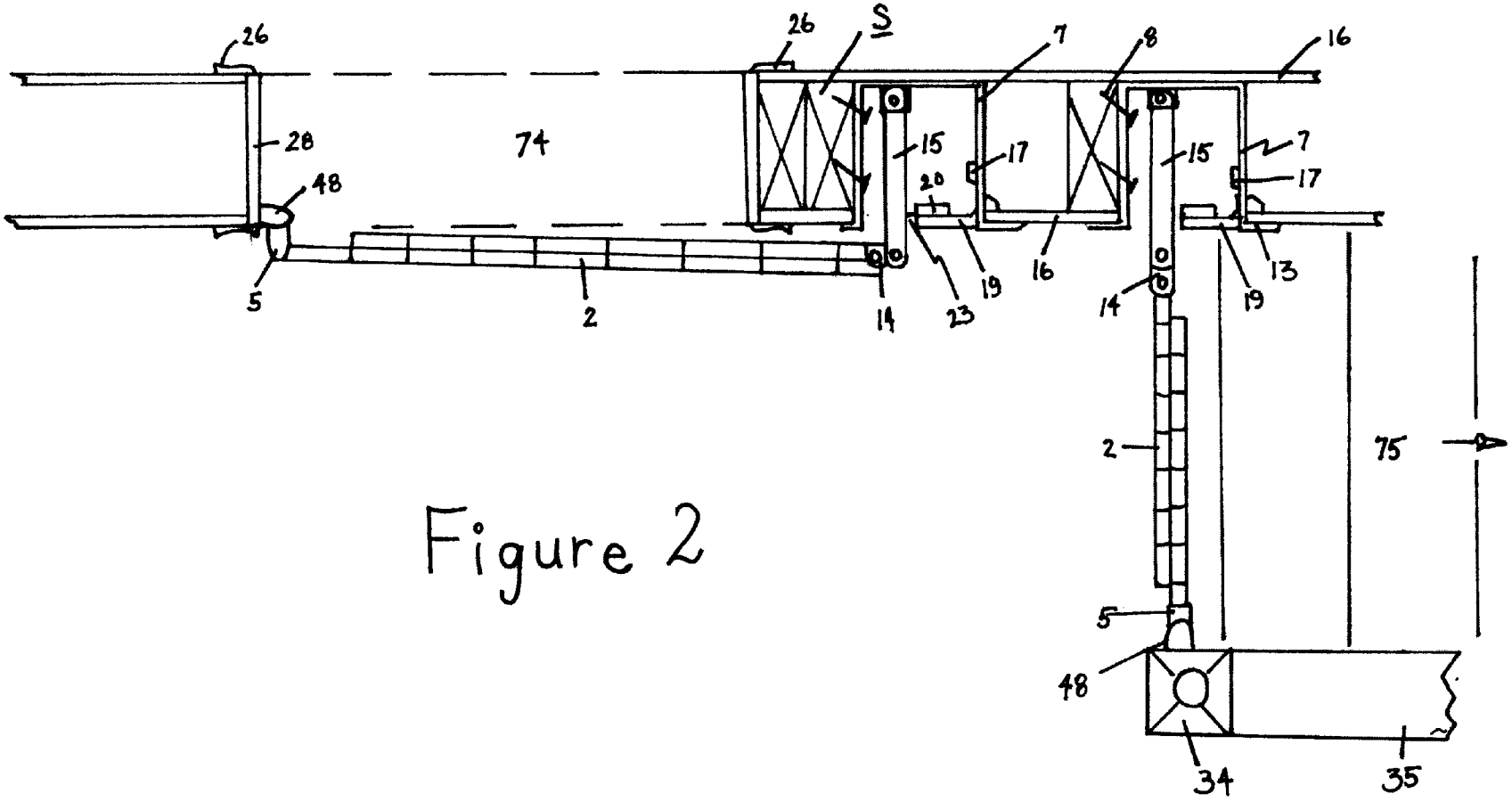
FIG. 2 is an illustration of the invention of FIG. 1 inserted into a finished wall with the accordion gate expanded and secured to a newel post and doorway jamb.

Each end 4 of the accordion gate 2 is secured to elements 5 in a pivotal fashion for compactness. Elements 5 are further secured via a rod 60 to elements 48. Elements 48 are secured to the rigid element, as shown in FIG. 2, such as door jamb 28 or newel post 34. What is important is that the method of lockingly attaching the gate to the rigid element is both tamper proof yet secure. The attachment should also be very easy to perform. What I mean by this is that it is my expectation that grandparents will have these gates installed in their homes to prevent grandchildren from injury. It is not uncommon for the elderly to have prescription glasses which provide substantial correction. Quite often there is a first prescription for distance and a second prescription for reading. It would not be unexpected that individuals may not have their reading glasses on when expanding the gate. With this in mind, the attachment of the gate should be a method that is readily performed without the need for an exacting motion. The illustration of FIG. 2 is meant to show the element 48 as being slipped onto screws or fasteners that are installed in the newel post 34 and handrail 35 or door jamb 28. FIG. 2 illustrates gate 2 as being expanded across a doorway threshold 74 and the threshold of a stairway 75. The means of fastening the end of the gate 2 to the opposite rigid member can be performed in various ways without departing from the spirit and scope of the claims.

FIG. 1 shows a pair of studs S secured adjacent a door jamb 28 and shimmed 27 as is commonly found in housing construction. The threshold is further trimmed with molding 26. The drywall commonly used during construction is ½ inch grade. However, just in case the wall board is ⅜ inch the housing 7 is provided with a gap G and a recess 24. The gap G would be eliminated if a ⅜ wall board is used. The recess 24 is provided for two reasons. The first reason is that the recess reinforces the integrity of the housing with the rib that is formed due to the recess. Note further reinforcing ribs 18 that appear on the top and bottom of the housing. Secondly, the recess provides an area into which the fasteners 25, such as a nut and bolt assembly that is flash welded, may extend. It is important to note that these fasteners are permanent and cannot be vibrated loose.

The gate assembly 1 includes two panels secured to housing 7. The first panel 19 is pivotably secured, via a hidden spring hinge 11, to the housing 7. The second panel 20 is hinged to the first panel 19 via a hidden hinge 10. Both panels will be painted a neutral color such as a highly durable gloss white which matches the trim 13 so as to give maximum cosmetic appeal. The panels may also be primed so as to be paintable by the consumer. The panel 20 is magnetically secured to the housing 7 by means of a ship lock. In this manner the gate assembly will be essentially flush mounted within the wall. The panels 19 and 20 are opened by pressing on the panels such that the ship lock, which is spring loaded, ejects the panels outward. Various other means may be employed to open the panels 19,20 such as recessed finger grips or other cosmetically appealing methods without departing from the spirit and scope of the claims.

Upon depressing panels 19 or 20, the panels will pop outward and be pivotably opened 90 degrees about spring hinge 11. The user will use handle 9 to grip the gate 2 and begin to pull the gate from the housing. The user will then fold the panel 20 back upon panel 19 so that they are back to back. Due to this arrangement there is provided a recess 21 in the back of panel 20. This recess is provided so that the gate movement detection device 22 can be secured to the back of panel 19. Wiring 40 extends from the detection device 22 to the on/off switch 17. Note that the detection device includes a position sensitive element 23 which, when displaced activates an alarm. The alarm is housed behind panel 33 and can be battery supplied or connected to house current. FIG. 2 best illustrates how the alarm is actuated. The user switches on and adjusts the volume of the alarm by switch 17. With the gate in an extended position and panel 19 returned to its proper position, the element 23 is in close proximity to the element 15. The gate is sensitive to initial movement due to the pivoting elements, such as between an element 5 and an element 48 and the motion between an element 15 and an element 14. Due to the short length of elements 5 and 14 the gate is not able to be displaced laterally by more than one inch. Elements 5 and 14 are essentially the same length so that the gate does not expand upon any lateral movement. FIG. 2 also illustrates the benefit that panel 19 provides both aesthetically and functionally. Panel 19 functions to prevent the gate 2 from moving laterally and prevents a child from turning off the alarm. Note that FIG. 2 is just one illustration of how an alarm can be incorporated into the invention. Various changes in both the location and activation of the alarm may be made without departing from the spirit or scope of the invention. Any reliable method that may include strain gauges, liquid switches or various other techniques may be employed.

As the length of the housing 7 gets longer, the more it is effected by movement within the house. The design of the assembly is to secure the end of the housing, farthest from the stud, to the finished wall. This will prevent any vibration noises from occurring when the stairs are being used. FIG. 1 illustrates how a clip 32 is snapped into place through a rectangular opening to secure the trim 13 to the finished wall. FIG. 1 illustrates the wall as being ½ inch in thickness.

Figure 4:
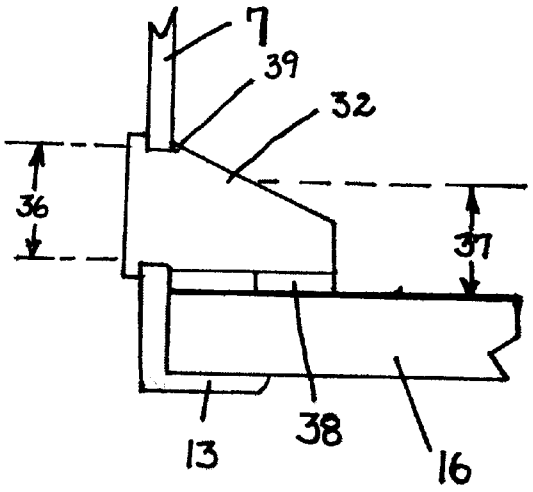
FIG. 4 is an illustration of the clip using a spacer wherein ⅜ inch gypsum board was used.

FIG. 4 illustrates the wall as being ⅜ inch in thickness. As shown in FIG. 4, the rectangular opening has a width measurement 36. The width of the clip end portion, including a spacer element or shim 38 is less than the width of the opening. The spacer element 38 is a rigid element with two-way adhesive so as to secure such to the clip prior insertion through the rectangular opening. Note that the clip 32 has a recess therein wherein the clip snaps rigidly into position once the lip portion or raised bead 39 engages the outer wall of the housing 7. The side of the housing 7 is also formed with additional rectangular templates, not shown, that can be punched out if needed. These additional templates are used with the clips 32 in houses/buildings that were built with plaster walls. The thickness of plaster walls exceeds the commonly found ½ inch gypsum board. It is also noted that the trim 13 does not have to be formed integrally with the housing 7 and could be added sometime after the housing 7 is secured within the wall. Other obvious modifications could be used to secure the housing to the finished wall to prevent vibration without departing from the spirit or scope of the invention.

As noted in FIG. 5, it is not uncommon for homes to be finished with base molding 41 and toe molding 42. Due to this molding, the bottom 46 of the gate assembly cannot be lowered in close proximity to the floor 43. In some instances the top of the molding may be four inches above floor level 43. This being the case, an accordion gate which merely extends straight out in a level manner would leave a substantial gap with the floor 43. A substantial gap in combination with the space formed between the accordion elements may allow an infant to crawl under such. Additional elements may be included so as to eliminate the gap formed between the accordion elements. However, the floor gap 72 would still be a concern depending on the base molding 41 height unless the molding is cutout and removed allowing the gate assembly to be placed at ground level. In this instance the manufacturer would have to be careful that a customer recognizes the need to remove the molding or sell only to new home builders/remodelers where the molding has not yet been installed.

Figure 3:
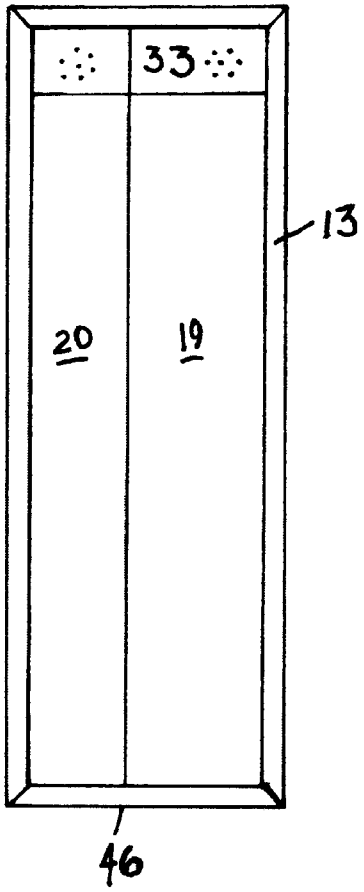
FIG. 3 is an illustration of the assembly of FIG. 1 after installation into a finished wall wherein a stud to the left of the assembly was selected.
Figure 10:
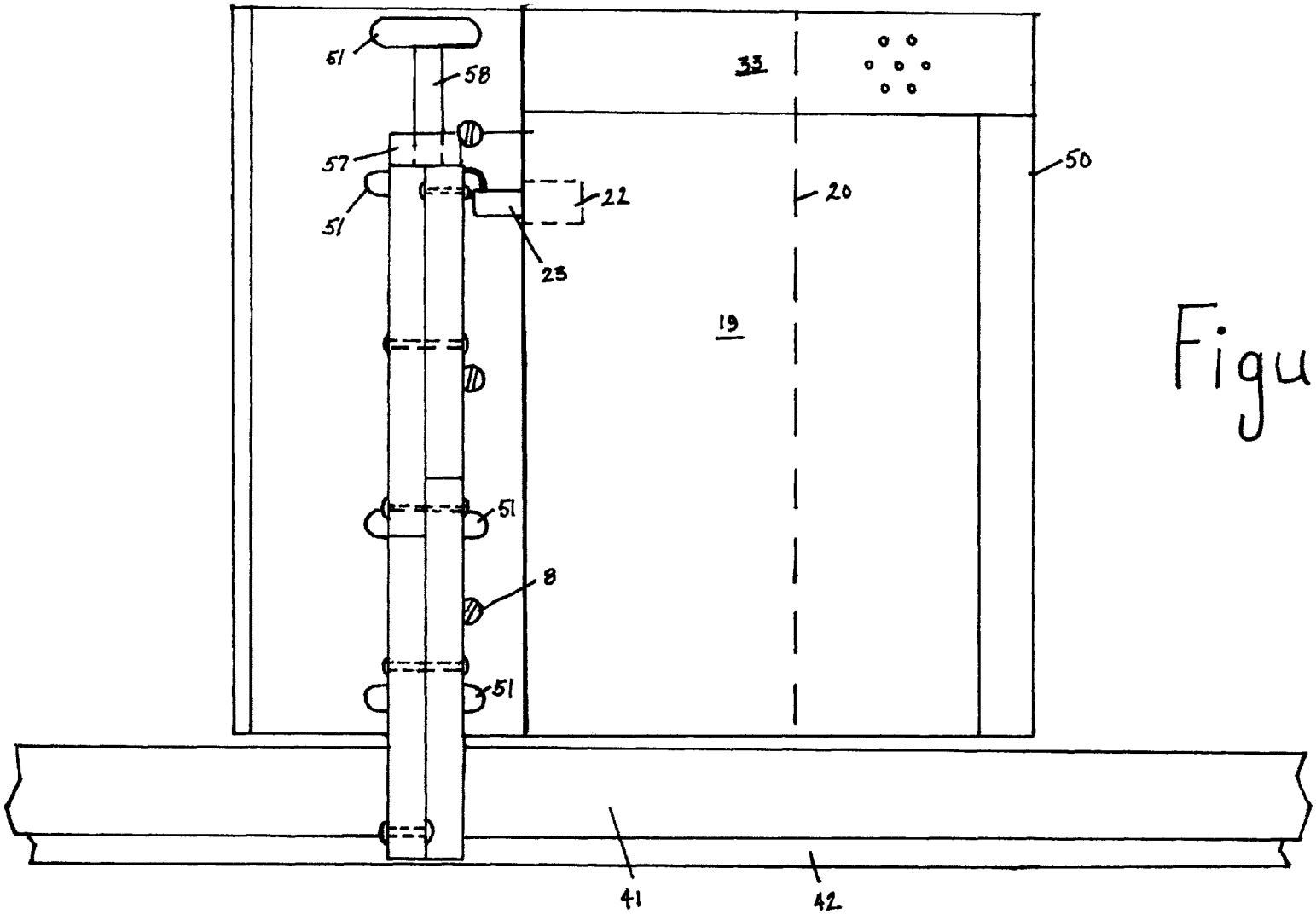
FIG. 10 is a section view of the invention of FIG. 9 wherein the gate is expanded.

As noted in FIG. 3, the panel 20 extends to the top of the housing 7. This is done so that once the panel 20 is folded back out of the way, the gate 2 can be extended then lowered as shown in FIG. 5. This aspect of the invention is also illustrated in FIG. 10. FIG. 5 illustrates how the height of the elements 14 and 61 combine to lower the gate below the lower edge 46 of the housing. The lower element 14 is secured to the lower element 15 allowing the upper element 14 to slide vertically as the gate is extended and collapsed. The user merely collapses the gate 2 and lifts it so that the elements 15 slide vertically along rod(s) 29 within the housing 7. Obvious modifications to the elements can be performed without departing from the spirit or scope of the invention.

Figure 6:
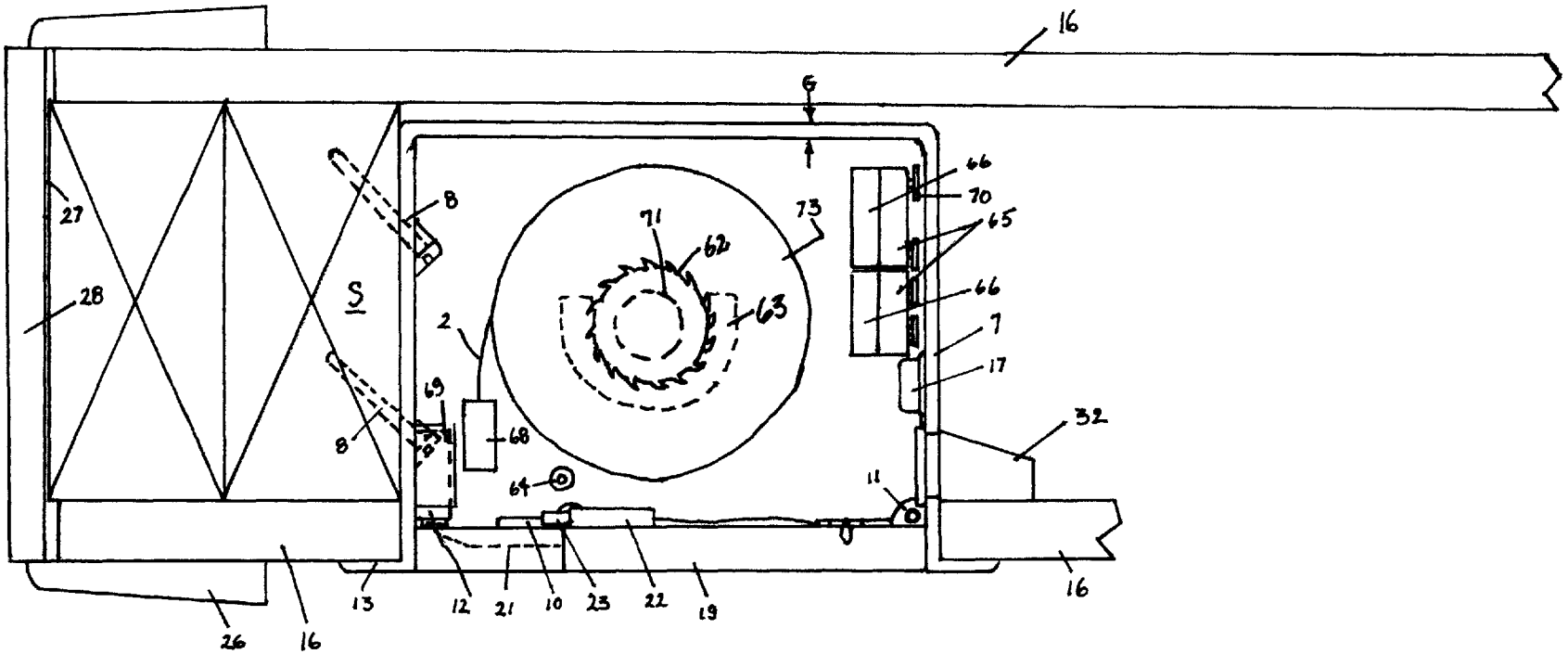
FIG. 6 is a sectional view of the invention wherein a rollable material is used for the gate.

FIG. 6 illustrates another embodiment of the invention wherein a rollable netting/fabric/material can be used to expand across the threshold or opening. One with ordinary skill in the art will be able to determine what rollable material would be acceptable for such a device. Spool 73 is a cartridge that is removably inserted into the housing 7. The material that forms the gate is spirally wrapped on the spool shaft 71. The lower end of the spool is provided with a splined shaft extension 62. The splined shaft extension has equally spaced and equally sized projections that do not allow the spool 73 to rotate in the counter-clockwise direction after installation of the shaft extension 62 into the holding bracket 63. A smooth shaft extension and holding bracket is also provided on the top of the housing 7 at the opposite end of the spool 73. The purpose of the cartridge being removable is for easy roll-up. It is clear that any spring mechanism devised to assist in re-rolling the material about the spool element 73 would fail in time.

Figure 7:
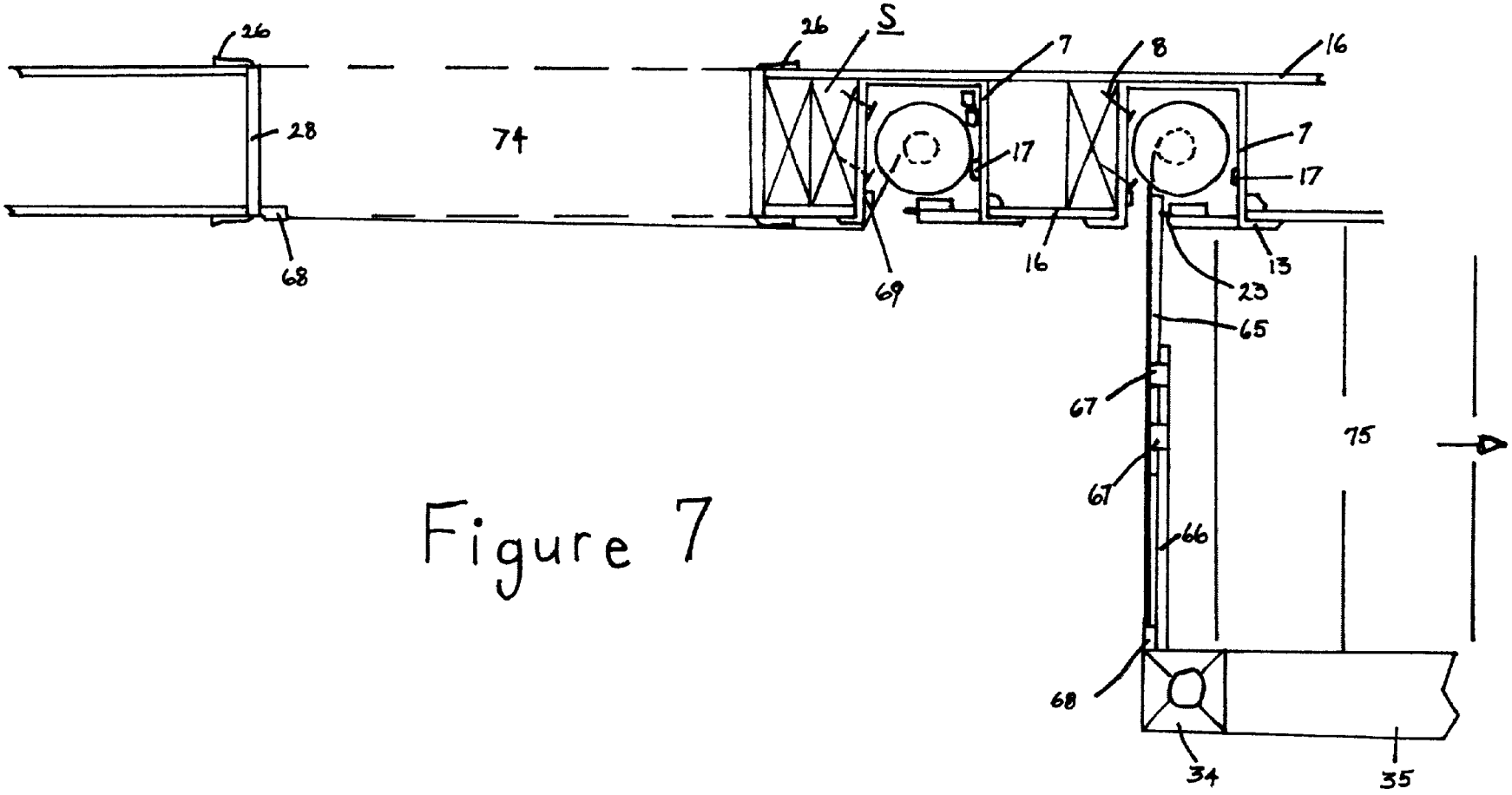
FIG. 7 is an illustration of the invention of FIG. 6 inserted into a finished wall with the rollable gate expanded and secured to a newel post and doorway jamb.
Figure 8:
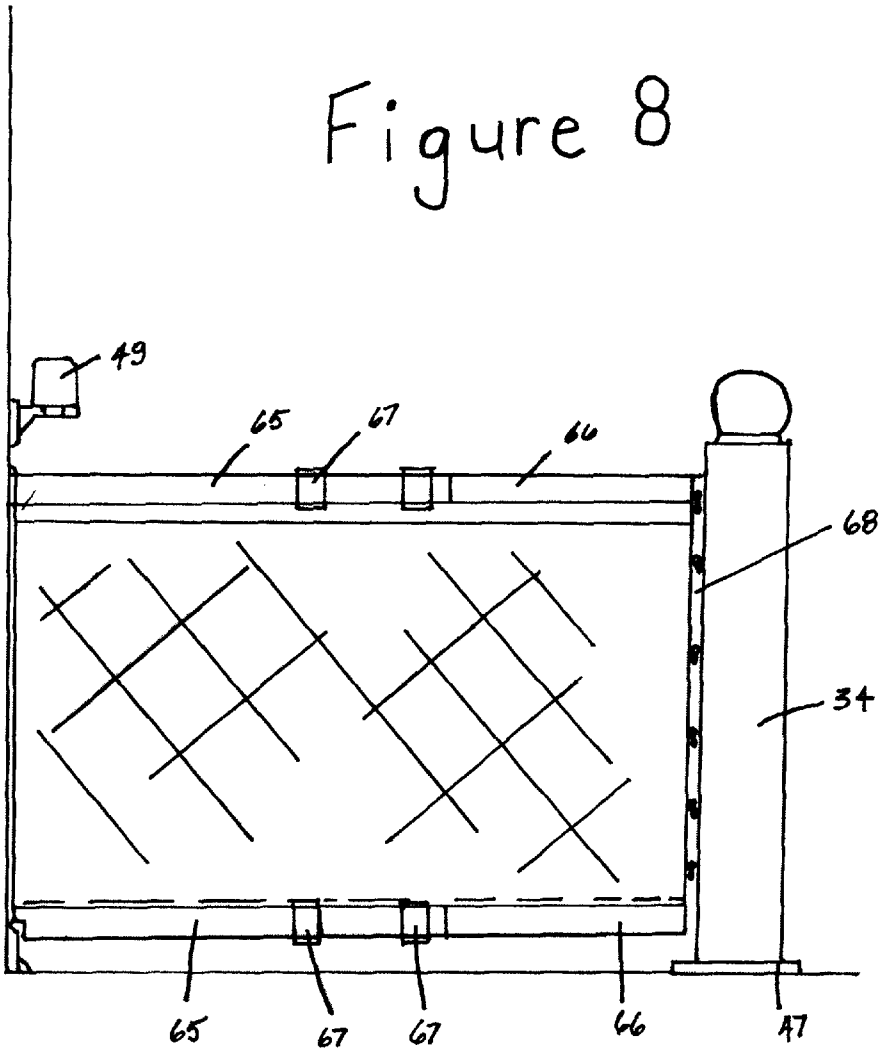
FIG. 8 is a side view of the gate assembly with the rollable gate.

The housing is sized sufficiently long enough to provide an area to store additional extension brackets 65,66. The extension brackets, as best seen in FIGS. 7 and 8, can be used in cooperation with the material gate. The extension brackets are slidably elongated by means of metal brackets 67. The brackets 65,66 are further provided with tabs 70 which lockingly engage the element 68 onto which the end of the gate is secured. The end element 68 hangs on a clip (not shown) within the housing 7 during storage. Note that the extension brackets are placed on the side of the material gate opposite from that in which a toddler may be standing as shown in FIGS. 7 and 8. Such an arrangement prevents children from trying to use the extension brackets as climbing elements to pass over the baby-gate. FIG. 6 further illustrates a rigid boss 64 onto which an extension bracket may be slidably mounted. Similar bosses are provided in the top of the housing. The material gate may include means to fasten such to the extension brackets. The extension brackets can be of any such design to fill the gap between the bottom of the material gate and the floor. The material gate may include cable or roping to reinforce areas of such.

An alternative to this combination material gate and extension bracket system is to form a platform within the housing 7 which rests on the base of the housing and is extendable outward and downward. An illustration is not provided but it is believed that one of ordinary skill in the art can readily construct such. It is further apparent that the platform would include side bracing elements and an upper element to secure the top of the spool in position. In this manner the platform could be extended and lowered such that the bottom of the material gate is in close proximity to the floor.

FIG. 7 is illustrative of the material gate being extended across a stairway threshold 75 and a doorway 74. Element 69 is an additional alarm switch which may be used when the material gate is extended in a direction away from the panel 19. An alternative is to have the alarm responsive to rotational motion of the spool.

Figure 9:
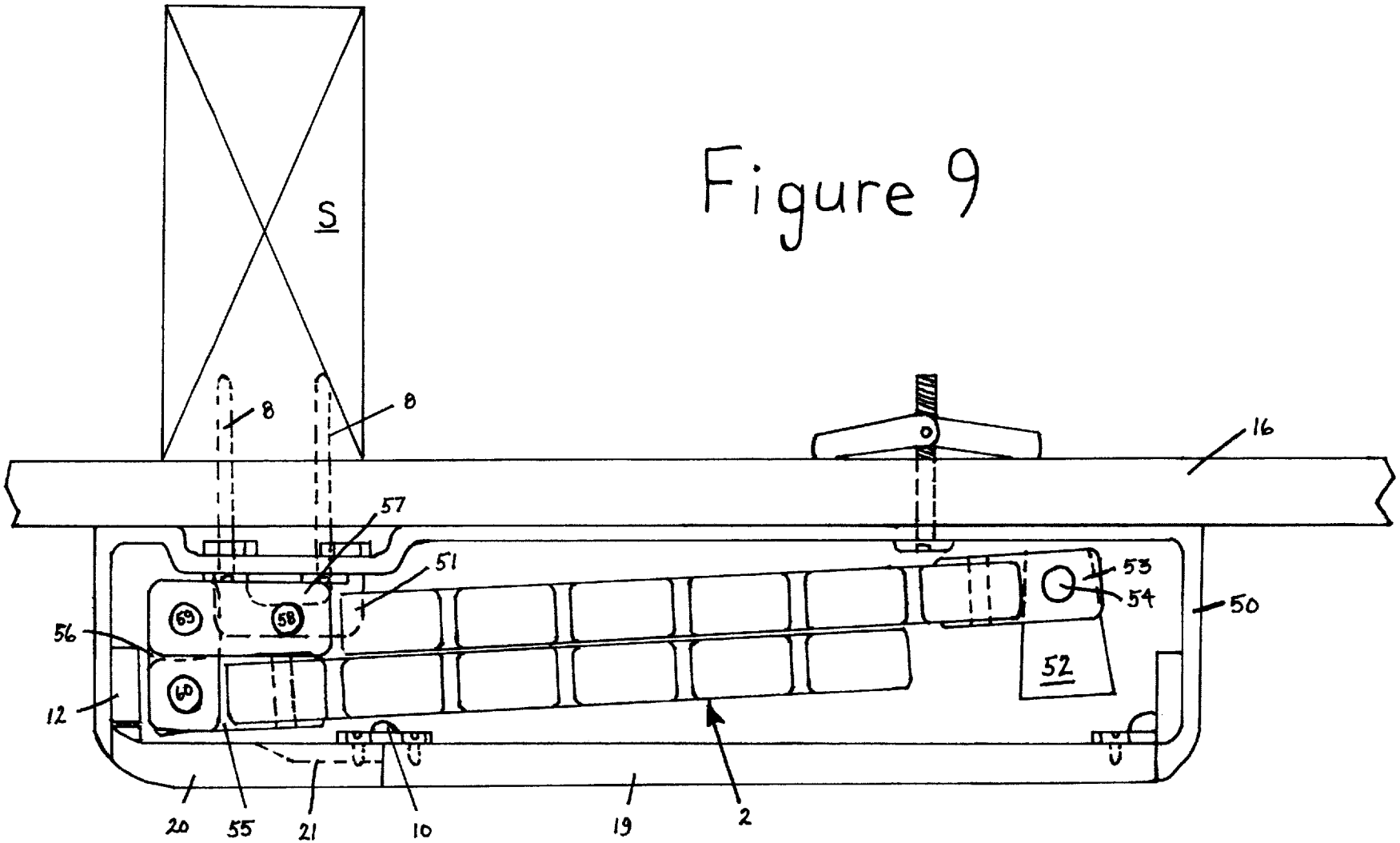
FIG. 9 is a sectional view of the invention mounted on a wall with the assembly using an accordion gate.

FIG. 9 is an embodiment of the invention mounted on the surface of a wall. The model depth is approximately 2 inches allowing for expansion and minor warping of the accordion gate 2. However, this depth may vary depending on the length of the housing and design of the gate assembly 2 without departing from the spirit and scope of the claims. A first end of the housing 50 is secured to a stud S or rigid element by screws 8 or fasteners. The other end of the housing 50 is secured to the finished wall by known fasteners such a molly bolts or butterfly screw assemblies as illustrated. The housing 50 is shallower than housing 7 since it is surface mounted on wall 16 and it therefor already projects beyond the base or toe molding on the wall surface. The element 57 is equivalent in function to element 15 of FIG. 1. The length of element 15 in FIG. 1 is dependant upon the depth of the recessed housing, the type of molding that can be found to project out from a finished wall and the length of elements 14 and 61. Likewise, the length of elements 57, 56 and 55 are such that the gate 2 must be able to extend out from the housing 50 a distance to clear the floor molding commonly found. Element 57 pivots about and is vertically adjustable along shaft(s) 58. The illustration of FIG. 10 shows elements 57 respectively mounted on shortened shafts 58. The shaft elements 58 are secured to the housing 50 by elements 51. By using two shorter shafts 58 in lieu of one long shaft 58, which would extend from the top of the housing 50 to the bottom of the housing, some benefits may be recognized. A single long shaft may be more expensive to produce and will be less stiff than two shorter shafts of similar material and diameter.

Element 56 of FIG. 9 is similar in function to element 14 in FIG. 1. And element 55 of FIG. 9 is similar in function to element 61 in FIG. 1. It should be apparent that the wall mounted gate kit of FIGS. 9 and 10 can therefor be lowered below the base of the housing just as the recessed assembly of FIG. 1. The result is that the wall mounted gate of FIGS. 9 and 10 will function as the recessed gate, as illustrated by FIG. 5, to avoid any gap being formed between the base of the gate and the flooring. In a similar fashion to the recessed housing, the surface mounted housing has two panels 19 and 20 which are opened by means of a ship lock 12. The element 52 of FIG. 9 is pivotably secured to element 53 via the rod 54. The element 52 is lockingly secured to the rigid element such as a newel post or door frame in a similar manner discussed hereinabove regarding element 48 of FIG. 1. As in the recessed gate assembly kit, the connection between elements 52 and 53 need not be pivotable if the length of the housing is not a factor. It is noted that the pivoting connection may have a benefit to the options available to secure this end of the gate to the rigid element. For example, if the rigid element has an angled surface with respect to the finished wall in lieu of a parallel surface, the benefit of being able to angle the element 52 may be recognized. It is also noted that the pivotal connection between the elements described may be designed to be tight to gain the benefit of firmness with the assembly.

Although a number of embodiments of the invention have been illustrated and described, various changes and modifications may be made without departing from the spirit and scope of the invention, as defined by the appended claims.

I claim:

1. An expandable partition kit comprising:

a housing having a lower edge, an expandable partition stored in said housing, said kit including fastening means securing said partition to said housing, and, said fastening means including means to lower a lower edge of said expandable partition below the lower edge of said housing.

2. The expandable partition kit of claim 1, wherein said kit is installed within a wall.

3. The expandable partition kit of claim 2, wherein said kit is installed with an outermost surface of the housing being essentially planar with a finished surface of said wall.

4. The expandable partition kit of claim 2, wherein said kit is installed as a unit.

5. The expandable partition kit of claim 1, wherein said kit includes an alarm activated by movement of said partition.

6. The expandable partition kit of claim 1, wherein said housing is mounted on a wall surface.

7. The expandable partition kit of claim 6, wherein said kit is mounted as a unit.

8. An expandable partition kit comprising:

housing means, said housing means having an axis along its length, an expandable stiff partition stored in said housing means along said axis, said partition being pivotably secured to said housing means such that it is expandable at an acute angle to said axis.

9. The expandable partition kit of claim 8, wherein said housing means is closable by panel means behind which said partition is wholly hidden.

10. The expandable partition kit of claim 8, wherein said housing is mounted on a wall surface.

11. The expandable partition kit of claim 10, wherein said axis is parallel to the plane of said wall.

12. The expandable partition kit of claim 8 wherein the housing means is installed into a wall.

13. The expandable parition kit of claim 12, wherein said housing means is closable by panel means behind which said partition is wholly hidden.

14. The expandable partition kit of claim 12 wherein the housing means is provided with trim, said trim being in engagement with a finished surface of the wall after installation, said kit including means to cause the engagement.

* * * * *